US005588089A

United States Patent [19]

Beerends et al.

[11] Patent Number: 5,588,089

[45] Date of Patent: Dec. 24, 1996

[54] BARK AMPLITUDE COMPONENT CODER FOR A SAMPLED ANALOG SIGNAL AND DECODER FOR THE CODED SIGNAL

[75] Inventors: John G. Beerends, The Hague; Frank Muller, Delft; Robertus L. A. van Ravesteijn, Voorburg, all of Netherlands

[73] Assignee: Koninklijke PTT Nederland N.V., Groningen, Netherlands

[21] Appl. No.: 437,360

[22] Filed: May 9, 1995

Related U.S. Application Data

[60] Division of Ser. No. 54,428, Apr. 28, 1993, which is a continuation-in-part of Ser. No. 771,748, Oct. 4, 1991, abandoned.

[30] Foreign Application Priority Data

Oct. 23, 1990 [NL] Netherlands ..... 9002308

[51] Int. Cl.[6] ..... G10L 3/02

[52] U.S. Cl. ..... 395/2.14; 395/2.12; 395/2.2; 395/2.28; 395/2.39

[58] Field of Search ..... 395/2, 2.28, 2.14, 395/2.12, 2.2, 2.39; 381/29–40

[56] References Cited

U.S. PATENT DOCUMENTS

| | | | |
|---|---|---|---|
| 4,742,550 | 5/1988 | Fette | 395/2.28 |
| 4,964,166 | 10/1990 | Wilson | 395/2 |
| 4,991,213 | 2/1991 | Wilson | 395/2 |
| 5,012,517 | 4/1991 | Wilson et al. | 395/2 |
| 5,042,069 | 8/1991 | Chhatwal | 395/2 |

FOREIGN PATENT DOCUMENTS

| | | | |
|---|---|---|---|
| 2060321 | 4/1981 | United Kingdom | G10L 1/00 |

OTHER PUBLICATIONS

L. R. Rabiner et al, Chapter 8, Digital Processing of Speech Signals, Prentice Hall, New Jersey.

Vary et al, Frequenz, vol. 42, No. 2–3, 1988; pp. 85–93, Sprachcodec Fur Dass Europaische Funkfernsprechnetz.

B. Scharf et al, Handbook of Perception and Human Performance, Chapter 14, pp. 1–43, Wiley, New York, 1986.

P. Chang et al, Fourier Transform Vectors Quantisation for Speech Coding, IEEE Transactions and Communications, vol. Com. 35, No. 10, pp. 1059–1068.

(List continued on next page.)

*Primary Examiner*—Kee M. Tung

*Attorney, Agent, or Firm*—Frishauf, Holtz, Goodman, Langer & Chick

[57] ABSTRACT

In a speech coder, a sampled analog signal is filtered by a short-term prediction filter. The result, a segmented residual signal, is transformed from a time domain to a frequency domain into several frequency components, each having a frequency-component amplitude. If a number of new amplitudes is calculated by combining the several frequency-component amplitudes, such that the number of new amplitudes is smaller than the several frequency-component amplitudes, a more efficient coder is created. The reduction of the quality of speech coding, due to loss of information, could be decreased if this calculation is based on the so-called Bark scale (critical frequency bands). In a corresponding speech decoder, at the hand of the number of new amplitudes several new frequency-component amplitude are calculated (the number of new amplitudes being smaller than the several new frequency-component amplitudes), which then are inverse transformed from a frequency domain to a time domain into new subsegments. These new subsegments are inverse filtered by an inverse short-term prediction filter to generate a signal which is representative for a sample analog signal.

8 Claims, 3 Drawing Sheets

OTHER PUBLICATIONS

Hermansky et al, Perceptually Based Linear Predictive Analysis of Speech, Mar., 1985, pp. 509–512, vol. 2 of 4 ICASSP 85 IEEE.

Mazor et al, Adaptive Subbands Excited Transform(ASET) Coding Apr., 1986, pp. 3075–3078, vol. 4 of 4, ICASSP '86, IEEE.

Yatsuzuka et al, Hardware Implementation of 9.6/16 KBIT/S APC/MLC Speech Codec and Its Applications for Mobile Satellite Communications, Jun., 1987, pp. 418–424 CC–87, IEEE Conference '87 Seattle.

Fette et al, Experiments with a High Quality, Low Complexity 4800 bps Residual Excited LPC (RELP) Vocoder, Apr. 1988, pp. 263–266, vol. 1, ICASSP 88, IEEE.

Schroeder et al, Optimizing Digital Speech Coders by Exploiting Masking Properties, of the Human Ear, Journal Acoustic Soc. of America, Dec., 1979, pp. 1647–1652.

Johnston, Transform Coding of Audio Signals Using Perceptual Noise Criteria, IEEE Journal on Selected Areas of Communication vo. 6, No. 2, Feb. 1988.

Atal, Predictive Coding of Speech at Low Bit Rates IEEE, Transactions on Communications, vol. 30, No. 4, Apr., 1982.

BARK AMPLITUDE COMPONENT CODER FOR A SAMPLED ANALOG SIGNAL AND DECODER FOR THE CODED SIGNAL

The present application is a division of application Ser. No. 08/054,428 filed Apr. 28, 1993, which is a continuation-in part of U.S. patent application Ser. No. 07/771,748, filed Oct. 4, 1991 now abandoned. The invention relates to an apparatus for coding an analog signal having a repetitive nature.

CROSS-REFERENCES TO RELATED PATENT APPLICATIONS INCORPORATED BY REFERNCE

U.S. patent application of van der Krogt and von Ravenstein, U.S. Ser. No. 08/400,263, filed Mar. 2, 1995 now U.S. Pat. No. 5,528,629, which is a continuation of U.S. Ser. No. 08/298,374, filed Aug. 30, 1994 now abandoned , which is a continuation of U.S. Ser. No. 08/150,589, filed Nov. 10, 1993 now abandoned, which is a continuation of U.S. Ser. No. 08/027,919, filed Mar. 8, 1993 now abandoned, which is a continuation-in-part of U.S. Ser. No. 07/750,818, filed Aug. 27, 1991 now abandoned.

BACKGROUND OF THE INVENTION AND REFERENCES TO PUBLICATIONS (INCORPORATED HEREIN BY REFERENCE)

It is known that analog signals having a strongly consistent nature, such as for example speech signals, can be efficiently coded after sampling by consecutively performing a number of different transformations on consecutive segments of the signal which each have a particular time duration. One of the known transformations for this purpose is linear predictive coding (LPC), for an explanation of which reference can be made to the book entitled "Digital Processing of Speech Signals" by L. R. Rabiner and R. W. Schafer; Prentice Hall, N.J.; Chapter 8. As stated, LPC is always used for signal segments having a particular time duration, in the case of speech signals, for example, 20 ms, and is considered as short-term prediction coding. It is also known to make use not only of a short-term prediction (STP) but also of a long-term prediction (LTP) in which a very efficient coding is obtained by a combination of these two techniques. The principle of LTP is described in Frequenz, (Frequency), volume 42, no. 2–3, 1988; pages 85–93; P. Vary et al.: "Sprachcodec fü r dass Europäische Funkfernsprechnetz" ("Speech coder/decoder for that European Radiotelephone Network"), while an improved version of the LTP principle is described in the Dutch Patent Application 9001985.

OTHER REFERENCES WHICH ARE REFERRED TO BELOW

B. Scharf and S. Buus, "Stimulus, Physiology, Thresholds" in L. Kaufman, K. R. Boff and J. P. Thomas, editors, Handbook of Perception and Human Performance, chapter 14, pages 1–43, Wiley, N.Y., 1986P and Chang et al, in IEEE Transactions on Communications, Vol. COM 35, No. 10, pages 1059–1068.

SUMMARY OF THE INVENTION

An object of the invention is to provide an apparatus for very efficiently transmitting, i.e. with a small number of bits/sec.

Accordingly, an apparatus for coding an analog speech signal having a repetitive nature, includes a short-term predictive analyzer which performs a short-term prediction analysis on a quantized sampled analog speech signal to produce a quantized short-term prediction filter coefficient at a first output; and a short-term prediction filter which generates a segmented residual signal from the sampled analog signal. A divider divides the segmented residual signal into subsegments. A discrete Fourier transform circuit transforms the subsegments from a time domain to a frequency domain and provides several frequency components per subsegment, each frequency component having a frequency-component amplitude. A calculation circuit calculates a number of new amplitudes by combining the several frequency-component amplitudes, the number of new amplitudes being smaller than the several frequency-component amplitudes. The calculation circuit provides the new amplitudes at a second output.

According to the present invention, only the smaller number of new amplitudes is transmitted, instead of the larger number of frequency-component amplitudes, which increases the efficiency of the transmission, and which decreases the quality of speech coding, due to loss of information. This reduction of the quality of speech coding can be minimised if the calculation of new amplitudes is based on perception, which means that only that information is transmitted which is relevant for differences in the decoded received signal which can be detected by the human ear. For example, this can be realised by combining two frequency-component amplitudes of lower frequency-components for calculating a new amplitude and by combining four frequency-component amplitudes of higher frequency-components for calculating another new amplitude. In this case, six frequency-component amplitudes are combined to calculate two new amplitudes, which corresponds to an increase of the efficiency by a factor 3, without the quality, experienced by a listener, of speech reconstructed at a receiving side being impaired.

In the first place, use is made for this purpose of the known fact that the human ear is not sensitive to absolute phase values, but only to phase relationships, so that it is not necessary in principle to transmit the phase information from the residual signal to be coded, provided only that it is possible to reconstruct the original phase relationships at the receiving end.

In addition, use is made of the insight known for some time that human hearing functions in fact as a chain consisting of a number of filters having adjacent frequency bands but having different bandwidths, the so-called critical bands or Barks, the bandwidth of such critical bands being much smaller for low frequencies than for high frequencies. A frequency scale formed in accordance with this insight is referred to as a linear Bark scale. For a further explanation of the principle of the Bark scale, reference is made to B. Scharf and S. Buus, (cited above).

It is also pointed out that in speech coding the principle of first transforming a residual signal to be transmitted to the frequency domain and then transmitting the information available after this transformation has already been put forward earlier. For this purpose reference can be made, for example, to the paper entitled "Fourier Transform Vector Quantisation for Speech Coding" by P. Chang et al (cited above). According to this publication, however, after the transformation use is made of vector quantisation and there is no mention of transmitting purely amplitude information.

Preferably, the subsegments generated by the means for dividing the segmented residual signal are partially overlapping, to further increase the quality of speech coding.

The invention further relates to an apparatus for decoding a coded signal, like a coded signal coming from an apparatus for coding an analog signal having a repetitive nature.

A further object of the invention is to provide an apparatus for decoding a very efficiently coded signal, i.e. with a small number of bits/sec.

Accordingly, an apparatus for decoding a coded speech signal includes a first input receiving coefficients which have been determined in a short-term prediction analysis; and a second input receiving a number of new amplitudes which have been calculated by combining several frequency-component amplitudes. A calculator calculates several new frequency-component amplitudes, which number is smaller than the several frequency-component amplitudes. An inverse discrete Fourier transform circuit which inverse transforms the new frequency-component amplitudes from a frequency domain to a time domain into new subsegments. An inverse short-term prediction filter, having a first filter input receiving the coefficients and having a small filter input, coupled to the inverse discrete Fourier transform circuit, for receiving the new subsegments, so as to generate a series of samples which is representative of a sampled analog audio signal.

BRIEF DESCRIPTION OF THE DRAWINGS

The invention will be explained in greater detail below on the basis of exemplary embodiments with reference to the drawing, wherein.

DESCRIPTION OF THE PREFERRED EMBODIMENTS

Figure 1A:
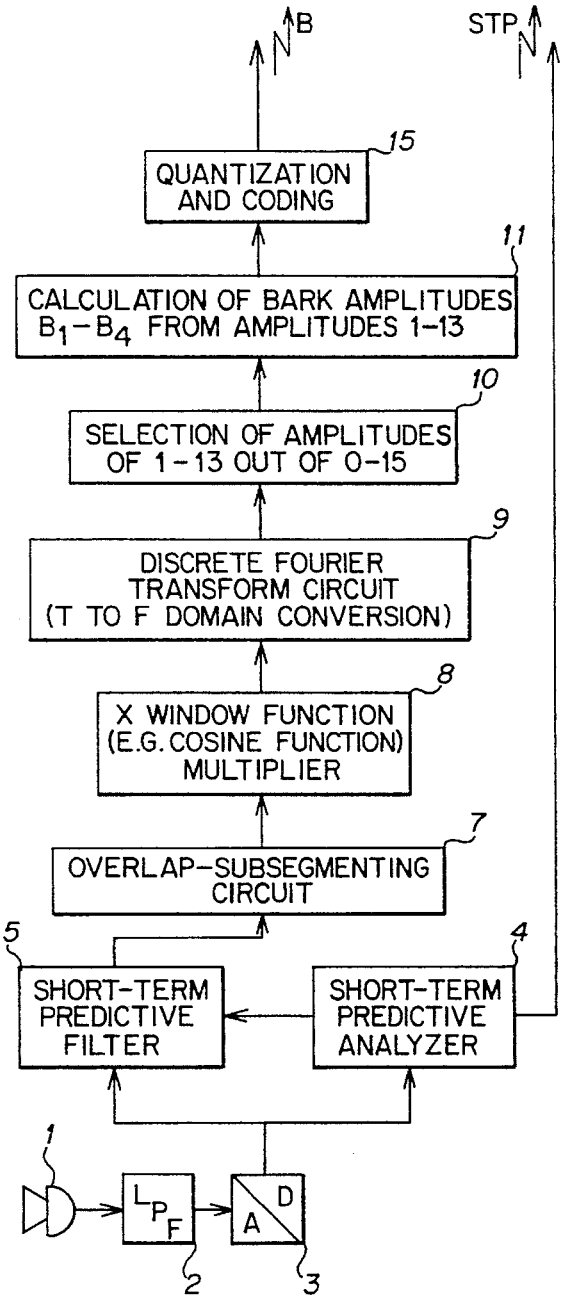
FIG. 1*a* shows a block diagram of an exemplary embodiment of a coding unit for the apparatus for coding according to the invention.

In FIG. 1*a* an analog signal delivered by a microphone 1 is limited in bandwidth by a low-pass filter 2 and converted in an analog/digital converter 3 into a series of amplitude and time discrete samples which is representative of the analog signal. The output signal (a quantised sampled analog signal) of the converter 3 is fed to the input of a short-term analysis unit 4 (means for performing a short-term prediction analysis) and to the input of a short-term prediction filter 5. These two units cater for the abovementioned short-term prediction (STP) on segments of, for example, 160 samples and the analysis unit 4 provides an output signal in the form of short-term prediction filter coefficients which are quantised, fed up to the short-term prediction filter 5 as well as coded and transmitted to the decoding unit shown in FIG. 1*b*. The structure and the function of the filter 5 and the unit 4 is disclosed and explained in the above-cited U.S. patent application Ser. No. 08/400,263.

The output signal of the STP filter unit 5 is referred to as the (segmented) residual signal. The segments of 160 samples in said residual signal are divided into 8 subsegments of 30 samples in the circuit 7 (means for dividing the segmented residual signal). This is done by first dividing the segment supplied into eight subsegments of 20 samples and then completing these at the leading edge with the ten last samples of the previous subsegment. This implies that the last ten samples of every segment have to be stored in order to also be able to complete the first subsegment of the subsequent segment. Compared to non-overlapping subsegments, overlapping subsegments cause an increase of the quality of speech coding. Then every subsegment of 30 samples is multiplied in a circuit 8 by a window function (means for multiplying each subsegment by a window function) such as, for example, a cosine function. The window function is so chosen that, for every sample in the overlapping parts of the subsegments, the sum of the squares of the two multiplication factors is unity. The reason that this has to be the case for the squares is that the multiplication by the window function takes place both in the coding unit and in the decoding unit shown in FIG. 1*b*. A Discrete Fourier Transform (DFT) is performed on the windowed subsegment in a circuit 9 (means for transforming the subsegments from a time domain to a frequency domain), 16 different frequency components being obtained for every subsegment. Of these 16 frequency components, numbered 0 to 15, the frequency-component amplitudes A of the frequency components 1 to 13 are calculated in a circuit 10 (means for transforming the subsegments from a time domain to a frequency domain). The frequency components 0, 14 and 15 can be ignored because they are situated outside the frequency band of 300–3,400 Hz chosen for speech communication. If a greater or a smaller frequency band is relevant, the number of frequency-component amplitudes taken into consideration can be adjusted accordingly. Starting from the said 13 frequency component-amplitudes, less new amplitudes are calculated to increase the efficiency of the coding. For example, four new amplitudes like so-called Bark amplitude components are calculated in a circuit 11 (means for calculating a number of new amplitudes). These Bark amplitude components are amplitudes associated with frequencies which are situated equidistantly on a linear Bark scale. These new amplitudes or Bark amplitude components $B_1$ to $B_4$ can, for example, be calculated as follows from the DFT frequency-component amplitudes $A_1$ to $A_{13}$:

$$B_1 = \sqrt{A_1^2 + A_2^2}$$

$$B_2 = \sqrt{A_3^2 + A_4^2 + A_5^2}$$

$$B_3 = \sqrt{A_6^2 + A_7^2 + A_8^2 + A_9^2}$$

$$B_4 = \sqrt{A_{10}^2 + A_{11}^2 + A_{12}^2 + A_{13}^2}$$

In quantisation circuit 15 the Bark amplitude components are quantized and coded, after which they are transmitted, together with the coefficients determined in the short-term prediction analysis, to the decoding unit.

So, said residual signal is transmitted in coded form in a manner such that only perceptively relevant information is transmitted, to minimise the reduction of the quality of speech coding, which reduction is caused by the increase of the efficiency of the coding due to the calculation (by combining the frequency-component amplitudes) of fewer new amplitudes than the number of frequency-component amplitudes.

Figure 1B:
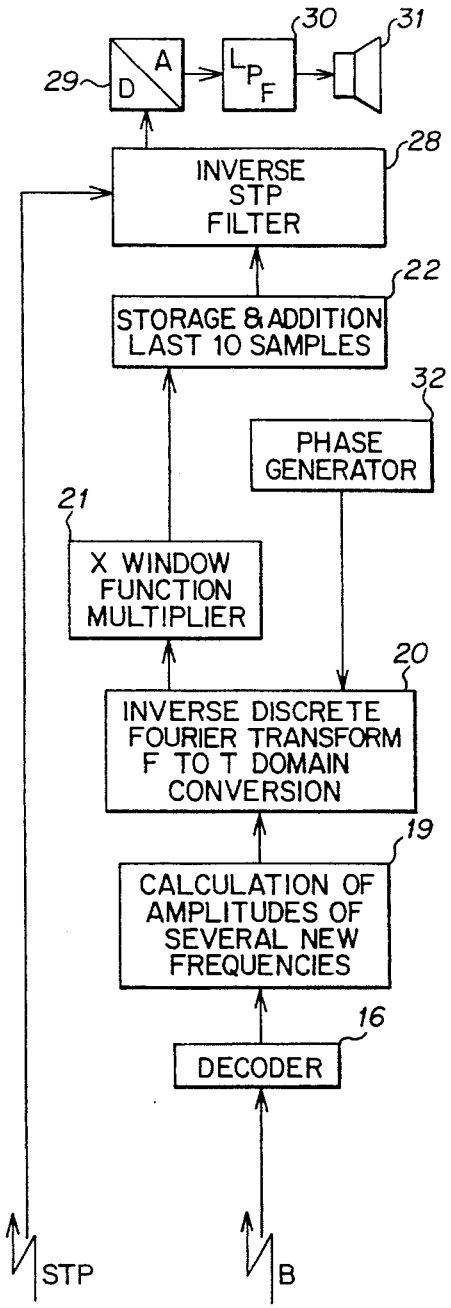
FIG. 1*b* shows a block diagram of an exemplary embodiment of a decoding unit for the apparatus for decoding according to the invention.

In FIG. 1*b* after decoding in a circuit 16 in the decoding unit, the reconstructed Bark amplitude components $B'_1$ to $B'_4$ are obtained. In a circuit 19 (means for calculating several new frequency-component amplitudes), the amplitudes in the frequency domain $A'_1$ to $A'_{13}$ (equidistant on the Hz scale) are calculated by means of the following formulae $$A'_1 = A'_2 = \frac{B'_1}{\sqrt{2}}$$

$$A'_3 = A'_4 = A'_5 = \frac{B'_2}{\sqrt{3}}$$

$$A'_6 = A'_7 = A'_8 = A'_9 = \frac{B'_3}{2}$$

$$A'_{10} = A'_{11} = A'_{12} = A'_{13} = \frac{B'_4}{2}$$

In order to be able to transform the 13 frequency components considered in the coder back to the time domain by means of an inverse DFT (IDFT) in the IDFT circuit 20 (means for inverse transforming), the amplitudes and the phases are required. In the decoding unit shown in FIG. 1*b* these phases are generated by a phase generator 32, which generates phases equal to 0 degrees or phases having a random value.

At the output of the circuit 20 a reconstruction of the subsegment, 30 samples long, is now available, but this has also been modified by the window function performed in the coder unit. The reconstructed or new subsegment is therefore multiplied again by the window function in a circuit 21 (means for multiplying each new or reconstructed subsegment by a window function). In the case of the first ten samples of the subsegment now multiplied twice by the window function, the last ten samples, stored for this purpose, of the previous subsegment multiplied twice by the window function are added in a circuit 22. As a result of this, the sum of the multiplication factors in the resultant ten samples is equal to unity.

The last ten samples in this subsegment are stored. The first twenty samples form a portion of the reconstruction of a segment of the STP residue. After eight subsegments have been reconstructed and combined, a completely reconstructed segment of the STP residue is obtained, and this is situated ten samples in the past with respect to the segment on which the STP analysis has been performed in the coding unit.

An inverse STP filtering is performed on this segment in a filter circuit 28 (inverse short-term prediction filter) in a manner known per se with the aid of the STP coefficients received, the filter coefficients from the previous segment being used for the first ten samples.

The output signal of the filter 28 is converted in a digital/analog converter 29 into an analog signal which is fed via a low-pass filter 30 to a loudspeaker 31 which gives a high-fidelity reproduction of the speech signal supplied to the microphone 1, it having been possible to transmit said speech signal in coded form with a low number of bits due to the measures according to the invention.

Figure 2A:
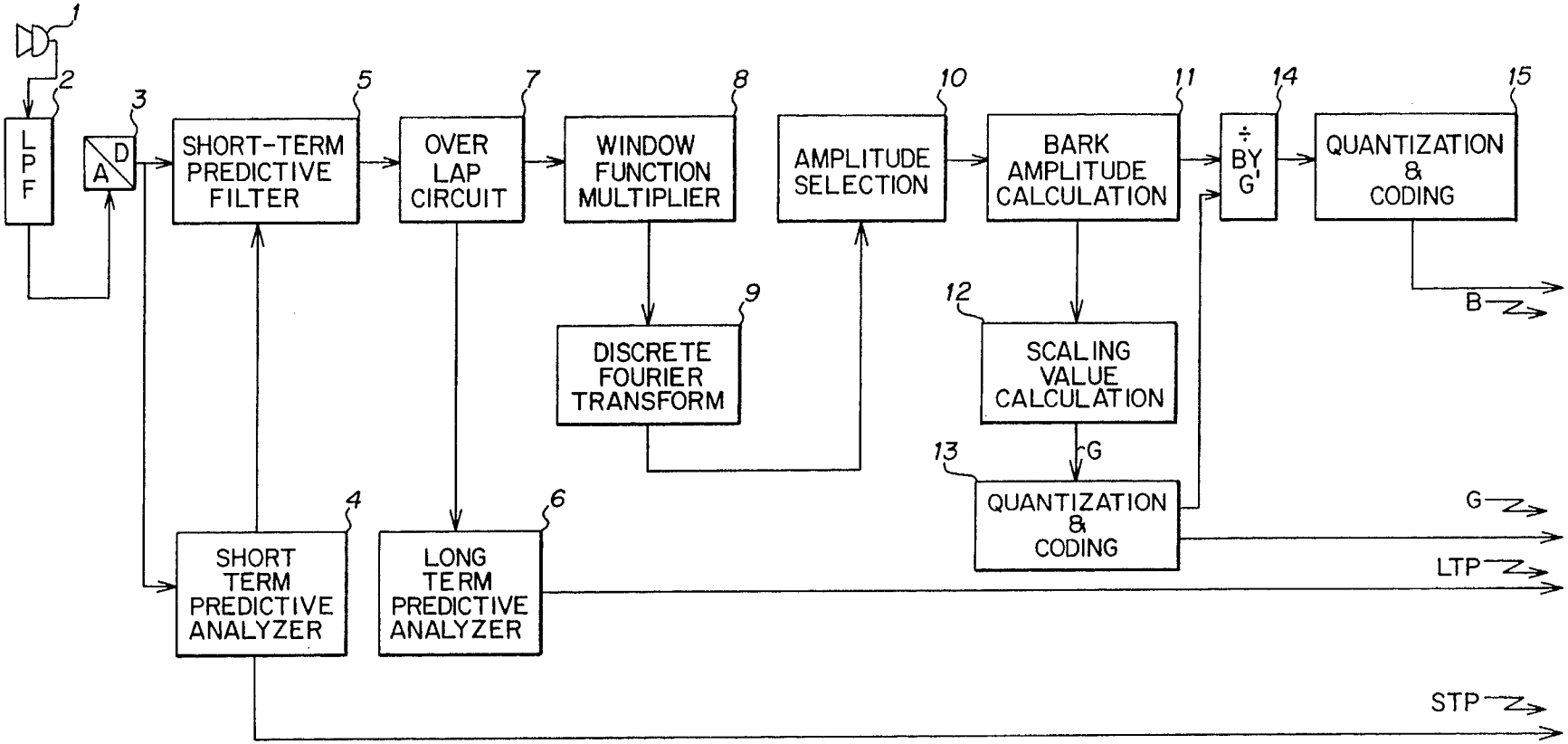
FIG. 2*a* shows a block diagram of a more complicated exemplary embodiment of a coding unit for the apparatus for coding according to the invention.

FIG. 2*a* shows a block diagram of a more complicated exemplary embodiment of a coding unit for the apparatus for coding according to the invention, which more complicated coding unit is equal to the coding unit shown in FIG. 1*a*, apart from the following.

The STP-filtered signal is fed through an overlap circuit 7 to a long-term prediction (LTP) analysis unit 6 (means for performing a long-term prediction analysis). In this analysis unit, an LTP analysis is applied twice per segment of 160 samples in a manner such as that described, for example, in U.S. patent application Ser. No. 08/400,263. In such an LTP analysis, for a signal subsegment to be coded, a search is made, in accordance with a particular search strategy, for a subsegment which is as similar as possible in a signal period preceding said subsegment having a particular duration and a signal is transmitted in coded form which is representative of the number of samples D situated between the starting instant of the subsegment found and the starting instant of the subsegment to be coded. This LTP analysis is preferably performed on non-overlapping subsegments.

Further, a gain factor G is calculated as a scaling value in circuit 12 (means for calculating a gain factor) from the four Bark amplitude components in accordance with:

$$G = \sqrt{B_1^2 + B_2^2 + B_3^2 + B_4^2}$$

The application of the scaling value G has the advantage that the scaled Bark amplitude components can be coded more efficiently. The value of G is quantized and coded in a circuit 13 and then transmitted to the decoding unit. If the scale factor G has been calculated, every Bark amplitude component is divided by the quantised gain factor G' in a circuit 14. The result of this division is quantized and coded in a circuit 15 (means for quantizing the new amplitudes), and then also transmitted to the decoding unit.

If no use is made of a scaling value, the circuits 12, 13 and 14 can be omitted and the four calculated values for the Bark amplitude components can be transmitted directly after quantization and coding in circuit 15.

Figure 2B:
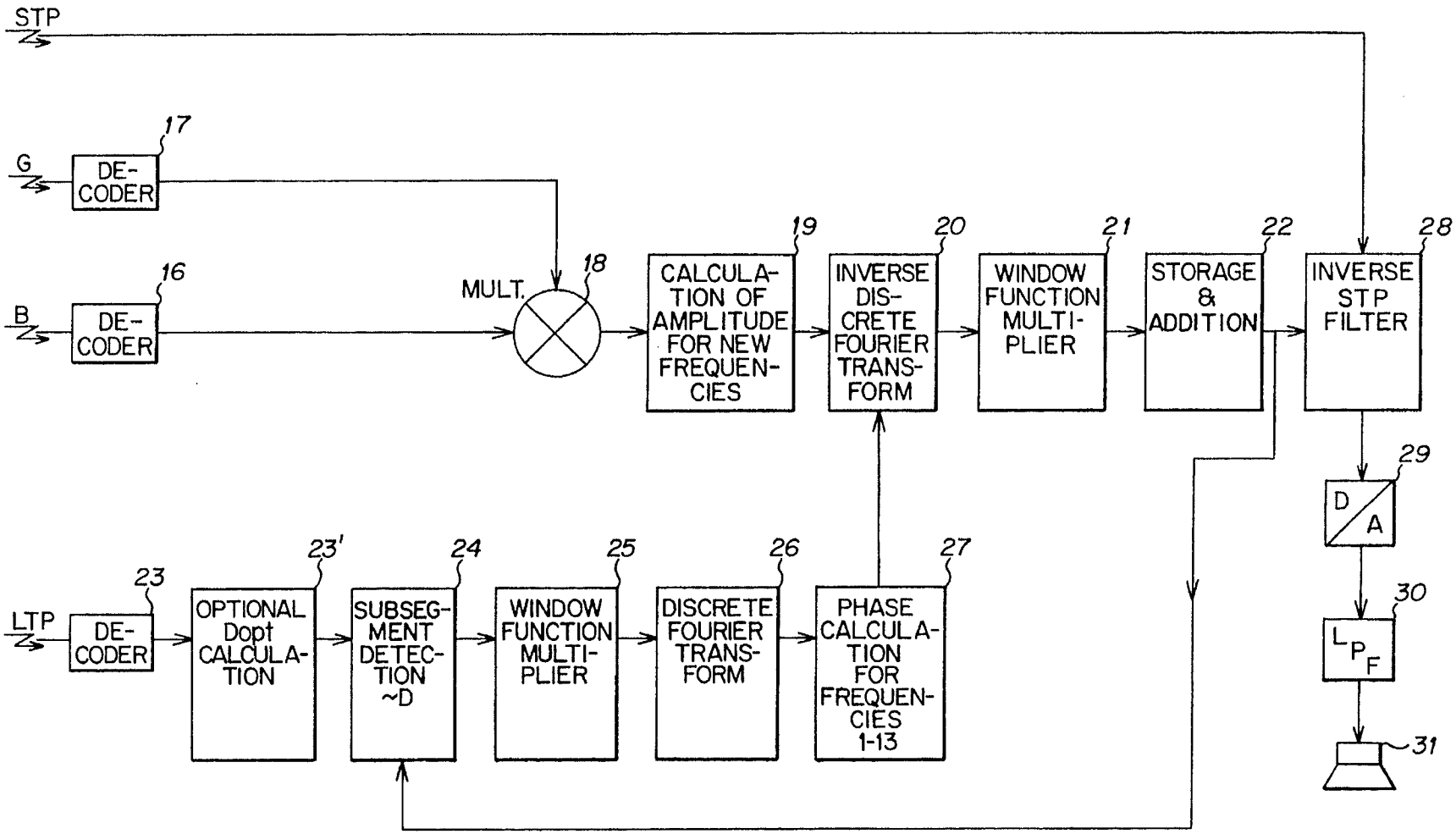
FIG. 2*b* shows a block diagram of a more complicated exemplary embodiment of a decoding unit for the apparatus for decoding according to the invention.

FIG. 2*b* shows a block diagram of a more complicated exemplary embodiment of a decoding unit for the apparatus for decoding according to the invention, which more complicated decoding unit is equal to the decoding unit shown in figure 1*b*, apart from the following.

The four scaled Bark amplitude components are multiplied in a multipler 18 (means for multiplying each of the received new amplitudes) by the quantized gain factor, G', decoded in a circuit 17, as a result of which the reconstructed Bark amplitude components $B'_1$ to $B'_4$ are obtained.

The phases necessary for circuit 20 are determined in the following manner with the aid of the LTP information decoded in a circuit 23 and consisting of the sample spacing D.

The 120 most recent samples of the reconstructed STP residue such as are present at the output of the circuit 22 to be discussed in greater detail below are stored in each case. In a circuit 24 (means for determining a subsegment), the subsegment is determined which is situated at a spacing of D samples in the past with respect to the present subsegment and this subsegment is multiplied in a circuit 25 by the same window function (means for multiplying each determined subsegment by the window function) as was used in the circuit 8 in the coder unit. A DFT is then applied to said subsegment in a circuit 26, after which the phases of the 13 components considered can be calculated in a circuit 27. With the aid of the phases determined in this way and the amplitudes already calculated, an IDFT is performed in the circuit 20, the amplitudes of $A'_0$, $A'_{14}$, $A'_{15}$ and $A'_{16}$ being set equal to zero.

Compared to the decoding unit shown in FIG. 1*b*, the more complicated decoding unit shown in FIG. 2*b* has a better speech quality, due to this calculation of the phases, instead of using phases equal to 0 degrees or phases having a random value as generated by phase generator 32 in FIG. 1*b*.

If desired, a circuit 23' can be included between the circuits 23 and 24 to first subject the value of D received by the decoder 23 additionally to a number of operations in order to obtain an optimum value of D for the reconstruction of the speech signal. These may be three consecutive operations.

1) If the series of values of D received exhibit a trend, the present D received, if it falls outside said trend by a certain margin, is replaced by a value which is in keeping with said trend. Equalizing algorithms for determining a trend in a series of consecutive values and for determining a replacement value for a signal which falls outside said trend are well known per se to those skilled in the art. So, in this case, circuit 23' comprises means for equalizing.

2) Three intermediate values ($I_1$, $I_2$ and $I_3$) are calculated between two consecutive values of D ($D_1$ and $D_2$), possibly adjusted with the aid of such an equalizing algorithm, by means of interpolation. This is done, for example, in the following manner:

$$I_1=0.75*D_1+0.25*D_2$$

$$I_2=0.50*D_1+0.50*D_2$$

$$I_3=0.25*D_1+0.75*D_2$$

The interpolation is carried out because the spacing D is determined in the coding unit twice per segment. Without interpolation, decoding of four consecutive subsegments would be carried out with the same value of D. If no fundamental regularity is present in the signal in the coding unit, a regularity would consequently wrongly be provided in the decoder during four subsegments. This problem is overcome by the interpolation. So, in this case, circuit 23' comprises means for calculating three intermediate values.

If fundamental regularity is in fact present in the speech signal, the repetition spacing in the signal will in general vary slowly. Due to the interpolation, the variation in the value of D now also has a smooth nature in the decoder.

3) After equalizing the values of D by, if necessary, calculating a replacement value and after interpolation, the calculated spacing D corresponds as well as possible with the actual repetition spacing present in the signal. If, however, said spacing D is less than 30, D is multiplied by an integer which is chosen in a manner such that the result is as a minimum equal to 30. This is necessary because all the samples of a subsegment at a spacing of less than 30 with respect to the present segment have not yet been reconstructed, so that they can therefore not be used to calculate the phases.

The reason that spaces D of less than 30 are nevertheless transmitted is that, if the fundamental regularity in the signal encompasses a number of samples less than 30, this prevents the decoded spacing D assuming values which are mutually unequal multiples of the actual repetition spacing. As a result of this, the equalization algorithm would have less opportunity of detecting a trend.

We claim:

1. Apparatus for decoding a coded signal, comprising:

a first input for receiving coefficients which have been determined in a short-term prediction analysis, a second input for receiving a number of new amplitudes of signals which have been calculated by combining several frequency-component amplitudes, means for calculating several new frequency-component amplitudes from the number of new amplitudes, the number of new amplitudes being smaller in number than the several new frequency-component amplitudes, such that at least two new frequency-component amplitudes are each a function of a first new amplitude and at least three new frequency-component amplitudes are each a function of a second new amplitude, means for inverse transforming the several new frequency-component amplitudes from a frequency domain to a time domain into new subsegements, an inverse short-term prediction filter, having a first filter input, coupled to the first input, for receiving the coefficients and having a second filter input, coupled to the means for inverse transforming, for receiving the new subsegments, for generating a series of samples which is representative for a sampled analog signal.

2. Apparatus according to claim 1, wherein the apparatus comprises:

a third input for receiving coefficients which have been determined in a long-term prediction analysis, means, coupled to the third input and to the means for inverse transforming, for determining a subsegment at a spacing of D samples with respect to a present subsegment, means for transforming the determined subsegment from a time domain to a frequency domain, means for calculating phases at the hand of the transformed determined subsegment and for providing these phases at the means for inverse transforming.

3. Apparatus according to claim 2, wherein the apparatus comprises:

a fourth input for receiving a gain factor as a scaling value, and means for multiplying each of the received new amplitudes by the gain factor.

4. Apparatus according to claim 3, wherein the apparatus comprises:

means for multiplying each new subsegment by a window function, means for multiplying each determined subsequent by the window function.

5. Apparatus according to claim 4, wherein the apparatus comprises:

means, coupled to the second input, for decoding the new amplitudes.

6. Apparatus according to claim 5, wherein that thirteen new frequency-component amplitudes $A'_1$ to $A'_{13}$ are calculated at the hand of four new amplitudes $B'_1$ to $B'_4$ in accordance with $$A'_1=A'_2=\frac{B'_1}{\sqrt{2}}$$

$$A'_3=A'_4=A'_5=\frac{B'_2}{\sqrt{3}}$$

$$A'_6=A'_7=A'_8=A'_9=\frac{B'_3}{2}$$

$$A'_{10}=A'_{11}=A'_{12}=A'_{13}=\frac{B'_4}{2}.$$

7. Apparatus according to claim 2, wherein the apparatus comprises:

means for equalizing a value of the spacing of D samples according to a predetermined algorithm.

8. Apparatus according to claim 2, wherein the apparatus comprises:

means for calculating three intermediate values $I_1$, $I_2$, $I_3$ for the value of the spacing of D samples between two consecutive values of the spacing of $D_1$ and $D_2$ samples in accordance with $$I_1=0.75*D_1+0.25*D_2$$

$$I_2=0.50*D_1+0.50*D_2$$

$$I_3=0.25*D_1+0.75*D_2.$$

* * * * *